US006698106B1

(12) United States Patent
Reithel et al.

(10) Patent No.: US 6,698,106 B1
(45) Date of Patent: Mar. 2, 2004

(54) DEHYDRATION DEVICE AND METHOD

(76) Inventors: Fredrick C. Reithel, 623 Caledonia Rd., Dix Hills, NY (US) 11746; Henry J. Sobota, 30 Glenwood La., Huntington, NY (US) 11743

( * ) Notice: Subject to any disclaimer, the term of this patent is extended or adjusted under 35 U.S.C. 154(b) by 0 days.

(21) Appl. No.: 10/314,459

(22) Filed: Dec. 9, 2002

(51) Int. Cl.[7] ..... F26B 3/00
(52) U.S. Cl. ..... 34/443; 34/90; 34/104
(58) Field of Search ..... 34/443, 98, 96, 34/104, 103, 90, 105, 106, 218

(56) References Cited

U.S. PATENT DOCUMENTS 3,791,368 A * 2/1974 Hunt ..... 126/25 A
5,333,540 A * 8/1994 Mazzocchi ..... 99/421
5,592,750 A * 1/1997 Eichten ..... 34/104

* cited by examiner

*Primary Examiner*—Henry Bennett
*Assistant Examiner*—Camtu Nguyen
(74) *Attorney, Agent, or Firm*—Eric C. Spencer

(57) ABSTRACT

A dehydration device and method is provided for the quick and efficient drying of garments wherein said dehydration device may be specifically adapted to receive an individual garment and may direct forced air into the interior volume of the garment to rapidly remove liquid and/or vapor from the garment. An optional heater may also be provided that is configured to accelerate the drying process.

13 Claims, 3 Drawing Sheets

DEHYDRATION DEVICE AND METHOD

BACKGROUND OF THE INVENTION

1. Field of the Invention

The present invention relates generally to the field of dryers for clothing and more specifically it relates to a dehydration device for use with various types of outer garments.

2. Description of the Prior Art

Numerous dryers have been provided in the prior art that are machines which remove water from clothes by tumbling the clothes in a closed container while providing forced hot air to remove the water. In addition, dryers have been provided that remove the water primarily from the exterior and interior of the garment by also applying forced hot air along the garment surfaces. While these units have been acceptable for that particular purpose, they are not well suited to remove water from the inside of a garment which has been specifically designed to be air and water tight as heretofore described.

SUMMARY OF THE INVENTION

A primary objective of the present invention is to provide a dehydration device that will overcome the shortcomings of the prior art devices.

Another object of the present invention is to provide a dehydration device that reduces the time needed to remove the moisture from a particular type of outer garment such as a safety suit, a divers suit, an environmental suit or a garment worn by fire and rescue personnel.

Yet another object of the present invention is to provide a dehydration device that is compact and lightweight for easy setup, tear down and transportation to various emergency sites.

Still another object of the present invention is to provide a dehydration device that is easily adjusted to work with various types, shapes and sizes of outer garments.

Yet another object of the present invention is to provide a dehydration device that is economical in cost to manufacture.

Further objects of the present invention will become apparent as the description herein proceeds.

According to a first general aspect of the present invention a dehydration device includes an enclosure having an air inlet and an air outlet with an air mover located in the enclosure. A support frame is provided located beneath and affixed to the enclosure. A distributor is provided in fluid communication with the air outlet and a plurality of exhaust pipes are in fluid communication with the distributor. The exhaust pipes are arranged to facilitate the dehydration of the inside volume and inside surface of a garment.

According to another general aspect of the present invention, a method of drying an internal surface and volume associated with a garment includes the steps of affixing an enclosure to a frame with an air mover being provided in the enclosure. An air inlet and an air outlet in said enclosure is provided to allow air into and out of the enclosure. A distributor is affixed to the enclosure such that the distributor receives air from the outlet and a plurality of exhaust pipes are in fluid communication with the distributor for the transmission of the air from the distributor to the internal volume of the environmental suit thereby removing a substantial amount of fluid from the garment.

To the accomplishment of the above and related objects, this invention may be embodied in the form illustrated in the accompanying drawings, attention being called to the fact, however, that the drawings are illustrative only of a preferred embodiment, and that changes may be made in the specific construction both illustrated and described and still be within the scope of the appended claims.

DETAILED DESCRIPTION OF THE PREFERRED EMBODIMENT

Figure 1:
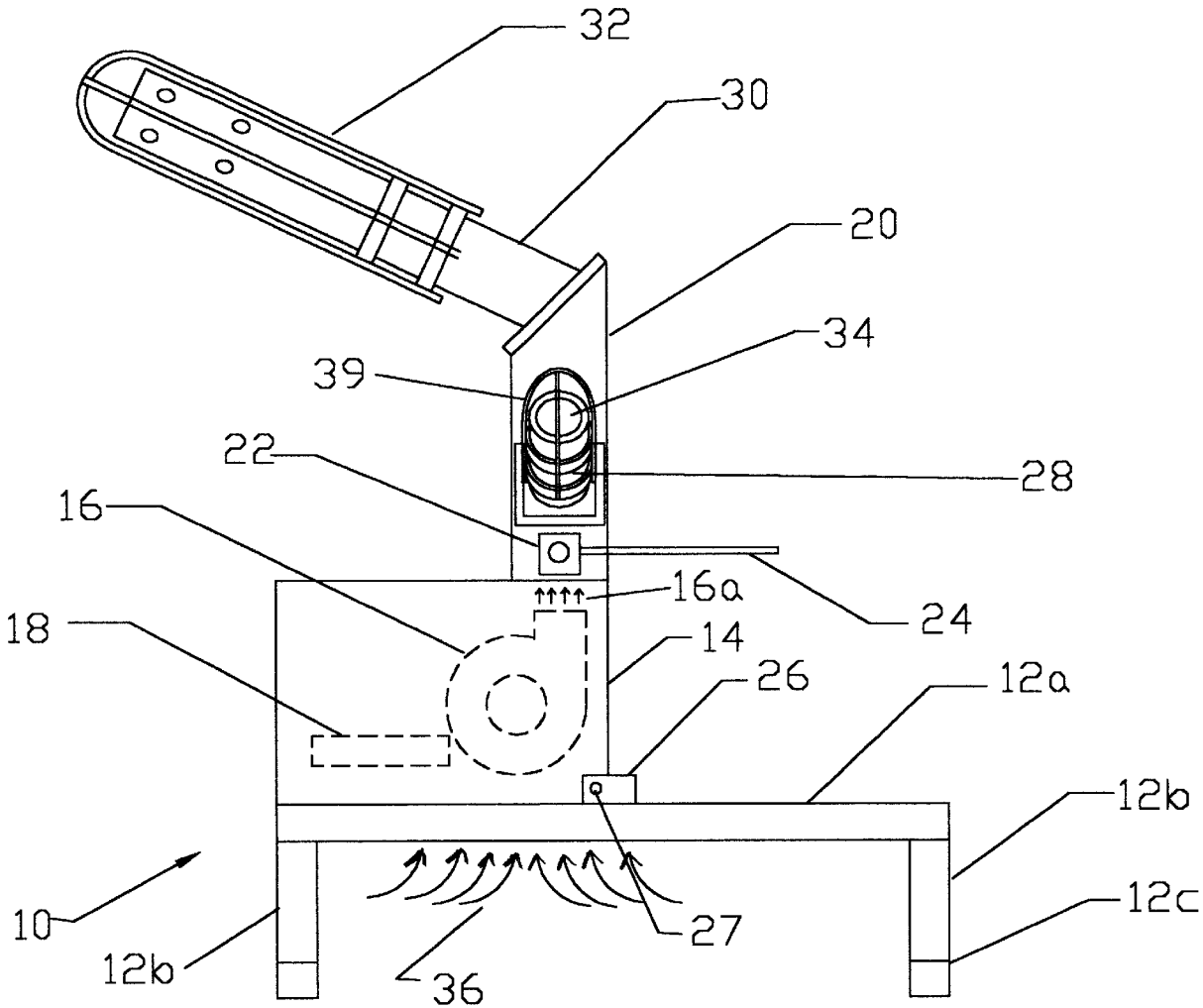
FIG. 1 is a simplified side view of the present invention with no garment installed.
Figure 2:
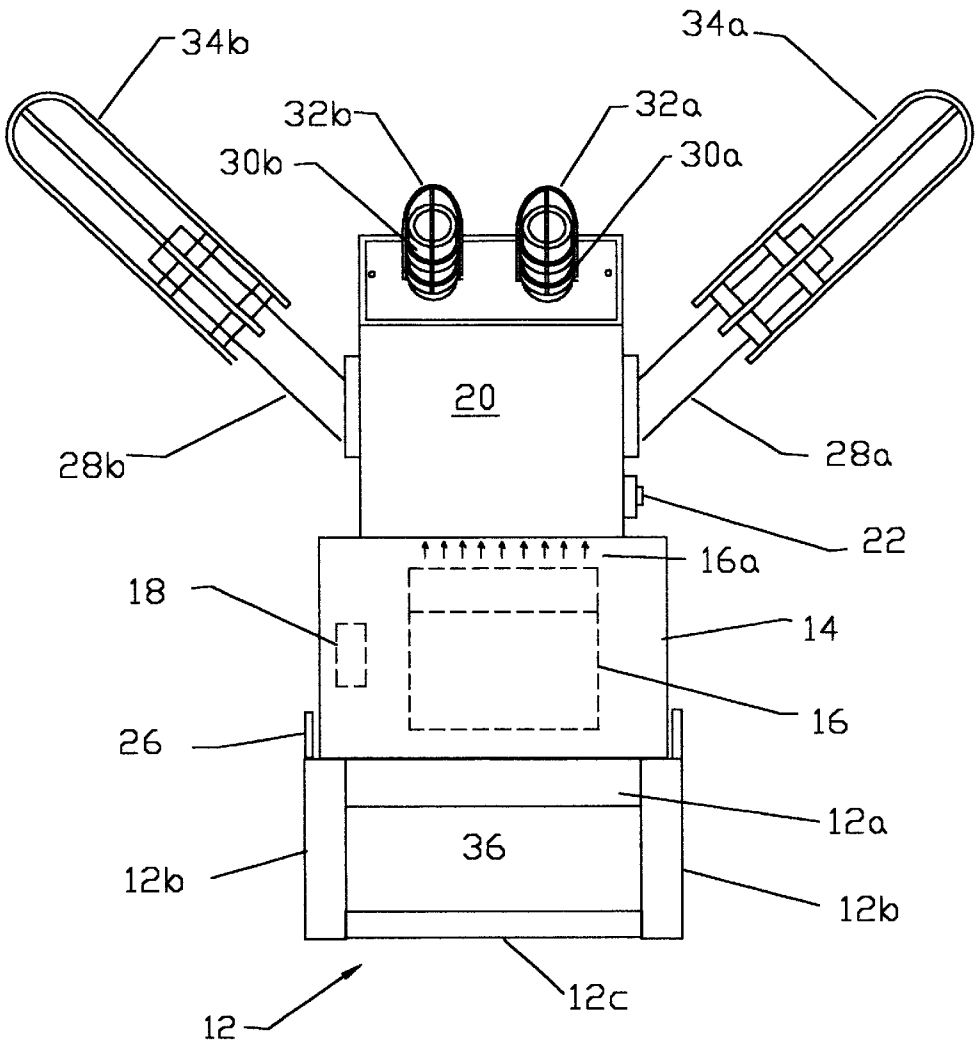
FIG. 2 is a simplified front view of the present invention with no garment installed.

Turning now to the figures, in which similar reference numerals denote similar features, FIGS. 1 and 2 illustrates a dehydration device 10 which is comprised of a support frame 12, an enclosure 14, an air mover 16, a distributor 20 and a first and second pair of exhaust pipes 28 and 30 respectively. The enclosure 14 is removably affixed to the frame 12 by a pair of pins 27 inserted in a hole located in a respective pivot 26. Pin 27 is inserted through pivot 26 and is received in a hole located in the enclosure 14 thereby affixing the enclosure 14 to the frame 12. The frame 12, as shown in the figures is comprised of a top planar surface 12*a* which is supported by a set of legs 12*b*. A pair of handles 12*c* are also provided between a pair of legs 12*b* for carrying the dehydration device 10 when it is in its stowed away configuration. In a preferred embodiment, the frame 12 is comprised of welded or bolted aluminum structural angles.

Provided in the enclosure 14 is the air mover 16 wherein the air mover outlet 16*a* is aligned with and in fluid communication with an air inlet of distributor 20. In a preferred embodiment, the air mover is a blower having a flow rate of approximately 1200 CFM. An optional heater 18 may also be provided in the enclosure 14 to raise the temperature of the air approximately 4–5 degrees F from ambient. In a preferred embodiment, the heater may be a wire wound resistive heater having a power output of approximately 725 Watts. Experimentation has shown that a dehydration device 10 having a blower with approximately 1200 CFM and a heater with a power output of approximately 725 Watts can dry a typical garment to an acceptable level within 15–20 minutes.

Removably attached to and protruding at a predetermined angle from the sides of the distributor 20 are first exhaust pipes 28*a* and 28*b*. First exhaust pipes 28*a* and 28*b* are configured to align and receive the arm locations of a typical garment when the garment is placed on the dehydration device. First frames 34*a* and 34*b* are slidably attached to a respective exhaust pipe and act to keep the garment stretched into an open position to facilitate the movement of air through the interior of the arm locations. The first frames 34*a* and 34*b* are adjustable to allow for the receipt of different size garments. In addition, the adjustable frames 34*a* and 34*b* allow the unit to be collapsed into a small package to ease transportation and storage of the dehydration unit. To further facilitate transportation and storage, the first exhaust pipes 28*a* and 28*b* may be completely removed from the distributor 20. In the preferred embodiment, this is accomplished by sliding the first exhaust pipes 28*a* and 28*b* out of a receptacle in the distributor 20.

Protruding from the top of the distributor 20 at a predetermined angle is a pair of second exhaust pipes 30*a* and 30*b*. The second exhaust pipes 30*a* and 30*b* are each configured to receive the leg portions of a typical garment when the garment is placed on the dehydration unit 10. Slidably attached to each second exhaust pipe 30*a* and 30*b* is a second frame 32*a* and 32*b* respectively. The second frames 32*a* and 32*b* are adjustable to allow for the receipt of different size garments. In addition, the adjustable frames 32*a* and 32*b* allow the unit to be collapsed into a small package to ease transportation and storage of the dehydration unit. To further facilitate transportation and storage, the second exhaust pipes 30*a* and 30*b* may be completely removed from the distributor 20. In the preferred embodiment, this is accomplished by removing a fastener that holds the second exhaust pipes to the distributor 20.

In t he preferred embodiment, the dehydration unit is powered by typical house voltage 110V that allows the dehydration unit to be used in almost any location. As shown in the figures, an optional on/off switch 22 is provided on the dehydration unit 10 which allows the user to quickly and easily start and stop the drying process.

Figure 3:
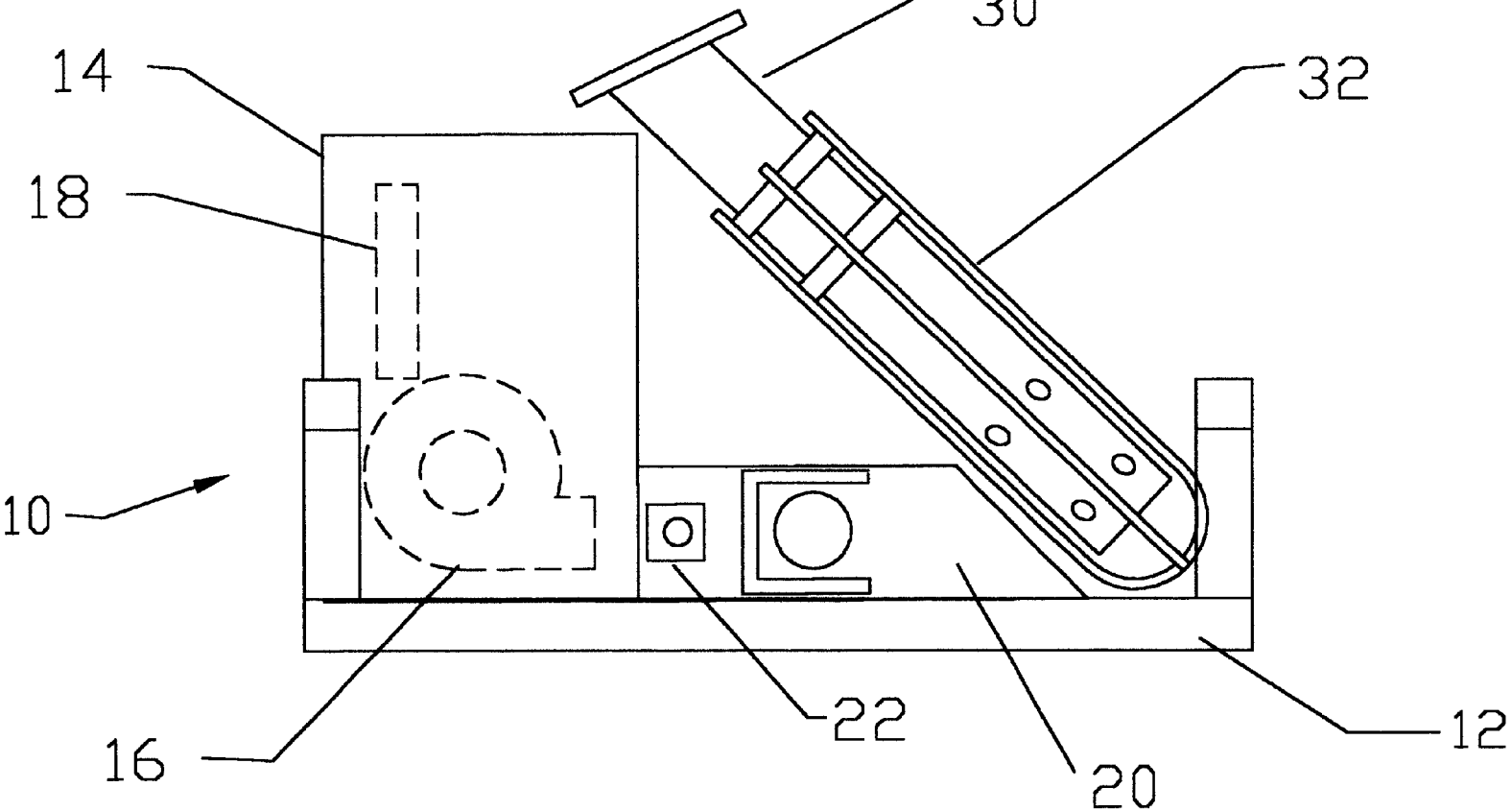
FIG. 3 is a simplified plan view of the present invention in a collapsed and stored configuration.

FIG. 3 shows the dehydration device 10 in its collapsed and stored configuration. In this configuration, the dehydration device 10 is easily stored and transported to a remote site. In a preferred embodiment, and not by way of limitation, the majority of the parts are fabricated from aluminum to reduce the systems overall weight. Once at the remote site, the dehydration device 10 quickly and easily is setup and put to use. To setup the dehydration device 10, the user removes the enclosure 14, distributor 20, the first set of exhaust pipes 28*a* and 28*b* and the second set of exhaust pipes 30*a* and 30*b* from the support frame 12. The support frame 12 may be turned over so it rests on its four legs and the enclosure 14 is attached to the frame as discussed previously. The distributor 20 is attached to the top of the enclosure 14 and the first and second set of exhaust pipes 28 and 30 respectively are removably affixed to the distributor 20 as discussed previously. The first and second frames 32 and 34 are extended from the first and second exhaust pipes 28 and 30 as discussed previously. A power cord 24 is plugged into a power source and the dehydration device 10 is ready to start drying various outer garments. To dry a garment, the garment is slid over the dehydration device 10 so that the leg portions of the garment surround the second exhaust pipes 30*a* and 30*b*. The arm portions of the garment are slid over and surround the first exhaust pipes 28*a* and 28*b*.

Once the garment is properly placed on the dehydration device 10, the operator starts the drying process by actuating the on/off switch 22 which in turn supplies power to the air mover 16 and the optional heater 18. Alternatively, the on/off switch 22 could be eliminated and the power controlled simply by plugging and unplugging the power cord. Air is then supplied into the blower through air inlet 36. If the heater 18 is provided, the air is heated as discussed previously and then forced up into the distributor 20 where it is further communicated to the first and second exhaust pipes 28 and 30 respectively. The air then exits air outlets 38 and 39 and impinges on the interior surface of the garment. The circulating air acts to enhance the drying process and helps to remove moisture from the garment quickly and efficiently.

What is claimed is:

1. A dehydration device for use with an outer garment comprising:

an enclosure having an air inlet and an air outlet, said enclosure further comprising an air mover to provide forced air through said dehydration device, a support frame located beneath and affixed to said enclosure, a distributor in fluid communication with said air outlet, a plurality of exhaust pipes in fluid communication with said distributor, said exhaust pipes being arranged to facilitate the dehydration of the inside volume and inside surface of the garment; and a slidable frame provided on each plurality of exhaust pipes, said slidable frame being configured to accept and receive a respective leg and arm portion of the garment.

2. The dehydration device of claim 1, wherein said air mover is one selected from the group consisting of a fan, a blower, and a paddle wheel.

3. The dehydration device of claim 1, further comprising a heater in thermal communication with the forced air, said heater configured to raise the temperature of the forced air.

4. The dehydration device of claim 1, wherein said dehydration device is configured to be disassembled and stored inside said support frame.

5. A method of drying an internal surface and volume associated with a garment comprising the steps of:

affixing an enclosure to a frame work, said enclosure comprising an air mover, providing an air inlet and an air outlet in said enclosure wherein said air mover receives air from said inlet and expels air from said outlet, affixing a distributor to said enclosure, wherein said distributor receives air from said outlet, affixing a plurality of exhaust pipes in fluid communication with said distributor for the transmission of air from said distributor to the internal volume of the garment, providing a slidable frame on each plurality of exhaust pipes, said slidable frame being configured to accept and receive a respective leg and arm portion of the garment and;

drying the internal volume and surface of the garment.

6. The dehydration device of claim 5, further comprising the step of providing a heater in thermal communication with the air.

7. The dehydration device of claim 5, further comprising the step of actuating an electrical switch disposed on the dehydration device to provide power to said air mover.

8. A dehydration device for the removal of liquid or vapor from the interior surface and volume associated with a garment comprising:

an enclosure means having an inlet means and an outlet means, an air mover means affixed in said enclosure means for transferring air from said enclosure inlet means to said enclosure outlet means, a distributor means affixed to said enclosure means for distributing the air from said enclosure outlet means to at least one first and second exhaust pipe means, a slidable frame means on each distribution means, said slidable frame being configured to accept and receive a respective leg and arm portion of the garment.

9. The dehydration device of claim 8, further comprising a support means abutting a surface of said enclosure means, said support means being configured to support said enclosure means a predetermined distance away from the ground.

10. The dehydration device of claim 8, further comprising a heater means configured to raise the temperature of the air to accelerate the removal of liquid and vapor from the garment.

11. The dehydration device of claim 8, wherein said dehydration device is configured to be disassembled and packaged to ease storage and transportation.

12. The dehydration device of claim 8, further comprising a pair of handles affixed to said frame means to facilitate the carriage and movement of said dehydration device.

13. The dehydration device of claim 8, further comprising a plurality of holes provided in each said first and second exhaust tube means.

* * * * *